US008740314B2

(12) United States Patent
O'Neill

(10) Patent No.: US 8,740,314 B2
(45) Date of Patent: Jun. 3, 2014

(54) BIT HOLDING SYSTEM WITH AN OPENING FOR REMOVAL OF BROKEN BITS

(75) Inventor: Michael L. O'Neill, Lucinda, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 561 days.

(21) Appl. No.: 13/004,407

(22) Filed: Jan. 11, 2011

(65) Prior Publication Data

US 2012/0175939 A1 Jul. 12, 2012

(51) Int. Cl.
*E21C 35/19* (2006.01)
*E21C 35/18* (2006.01)
*E21C 35/187* (2006.01)

(52) U.S. Cl.
CPC ..... *E21C 35/19* (2013.01); *E21C 35/18* (2013.01); *E21C 35/187* (2013.01)
USPC ..... 299/106; 299/110

(58) Field of Classification Search
USPC ..... 299/104, 106, 107, 110, 81.1, 81.2, 299/81.3
See application file for complete search history.

(56) References Cited

U.S. PATENT DOCUMENTS 3,397,012 A * 8/1968 Krekeler ..... 299/104
4,329,766 A 5/1982 Leonard et al.
4,343,516 A * 8/1982 Aden ..... 299/106
4,944,560 A 7/1990 Osterwise
5,088,797 A 2/1992 O'Neill
5,106,166 A 4/1992 O'Neill
5,302,005 A 4/1994 O'Neill
5,498,069 A * 3/1996 Siebenhofer et al. ..... 299/81.3
5,690,393 A * 11/1997 Massa et al. ..... 299/107
5,884,979 A 3/1999 Latham
6,129,422 A 10/2000 Siddle et al.
6,357,832 B1 3/2002 Sollami
6,364,420 B1 4/2002 Sollami
6,485,104 B1 11/2002 Keller
6,764,141 B2 * 7/2004 O'Neill ..... 299/81.3
6,786,557 B2 9/2004 Montgomery, Jr.
6,854,810 B2 2/2005 Montgomery, Jr.
7,192,095 B2 * 3/2007 Sansone et al. ..... 299/106

(Continued)

FOREIGN PATENT DOCUMENTS

DE 3332257 10/1984
DE 29710357 9/1997

(Continued)

OTHER PUBLICATIONS

Search Report from the Polish Patent Office for Application No. P-397778 dated May 11, 2012 (2 pages).

(Continued)

*Primary Examiner* — David Bagnell
*Assistant Examiner* — Michael Goodwin
(74) *Attorney, Agent, or Firm* — Michael Best & Friedrich LLP

(57) ABSTRACT

A cutting tool assembly including a bit holder having a forward portion, a rearward portion, and a generally planar mounting surface between the forward and rearward portions. The forward portion defines a front aperture having an axis inclined relative to the mounting surface, and the rearward portion defines a rear aperture open to the front aperture. A cutting bit is mounted in the front aperture and includes a rearward end accessible through the rear aperture of the bit holder rearward portion.

27 Claims, 8 Drawing Sheets

(56) References Cited

U.S. PATENT DOCUMENTS

| | | | | |
|---|---|---|---|---|
| 7,217,072 | B1 | 5/2007 | Haimer | |
| 7,270,379 | B2 * | 9/2007 | Stehney | 299/104 |
| 7,547,075 | B2 * | 6/2009 | Tewes et al. | 299/106 |
| 7,883,154 | B2 * | 2/2011 | Beach et al. | 299/81.3 |
| 2008/0036269 | A1 | 2/2008 | Hall et al. | |
| 2008/0093912 | A1 * | 4/2008 | Willoughby | 299/107 |
| 2008/0238000 | A1 | 10/2008 | Rimet | |
| 2011/0148179 | A1 | 6/2011 | Lehnert et al. | |
| 2011/0204701 | A1 | 8/2011 | Monyak et al. | |
| 2011/0266860 | A1 * | 11/2011 | Charlton | 299/107 |

FOREIGN PATENT DOCUMENTS

| | | |
|---|---|---|
| JP | 9183006 | 7/1997 |
| JP | 2008023607 | 2/2008 |
| WO | 02/090717 | 11/2002 |

OTHER PUBLICATIONS

Bit Holder, available prior to Jan. 7, 2011 (1 page).

Search Report from the United Kingdom Intellectual Property Office for Application No. 1200185.5 dated Mar. 22, 2012 (4 pages).

First Office Action from the Australian Intellectual Property Office for Application No. 2012200107 dated Mar. 12, 2014 (3 pages).

* cited by examiner

BIT HOLDING SYSTEM WITH AN OPENING FOR REMOVAL OF BROKEN BITS

FIELD

The present invention relates to mining and construction cutting bit holders. More specifically, embodiments of the invention relate to a bit holder assembly for removably mounting a cutting bit on a cutting tool.

BACKGROUND

In the mining field, and in other fields in which a large volume of hard materials must be cut, it is typical to employ an apparatus that includes a vertically moveable horizontal axis cutting drum having bit holders mounted on the cutting drum and cutting bits attached to the bit holders. As the cutting drum rotates, the cutting bits are moved into engagement with the surface to be cut, removing material from the surface for further processing. Generally, the cutting bits are used to cut, break, and/or crush earth, rock, pavement and the like.

These cutting tools are subjected to large torques and loads. Due to the substantial forces generated during the cutting operations, the cutting bits must be securely mounted on the bit holders, and must also be readily removable for replacement when they break or wear out. Depending on the material being cut, the cutting bits may need to be replaced daily.

SUMMARY

Thus, there is a need for a cutting tool assembly that allows easy removal from and replacement of the cutting bit from the bit holder, especially problematic when the cutting bit is bent or broken. While there are existing assemblies for mounting a cutting bit on a bit holder, they do not, in general, include a cutting assembly that comprises a rear aperture positioned at a rear portion of the bit holder body and coaxially aligned with a front aperture of the bit holder body such that at least a portion of the cutting bit can pass thought these apertures in any direction.

Accordingly, the invention provides a cutting tool assembly. The cutting tool assembly includes a bit holder comprising a forward portion, a rearward portion, and a generally planar mounting surface between the forward and rearward portions. The forward portion of the bit holder defines a front aperture having an axis inclined relative to the mounting surface, and the rearward portion defines a rear aperture open to the front aperture. The cutting tool assembly also includes a cutting bit mounted in the front aperture and including a rearward end accessible through the rear aperture of the bit holder rearward portion.

In another embodiment, the invention provides a cutting tool assembly. The assembly includes a bit holder comprising a forward portion, a rearward portion, and a generally planar mounting surface between the forward and rearward portions. The forward portion of the bit holder defines a front aperture having an axis inclined relative to the mounting surface. The rearward portion of the bit holder has a beveled surface adjacent the mounting portion and defines a rear aperture opening from the beveled surface, the rear aperture having an inner dimension and being open to the front aperture. The cutting tool assembly further includes a cutting bit mounted in the front aperture and including a shank portion having an outer diameter and a rearward end accessible through the rear aperture of the bit holder rearward portion, wherein the inner dimension of the rear aperture is larger than the outer diameter of the cutting bit to allow the shank portion of a broken cutting bit to pass through the rear aperture for removal.

Other aspects of the invention will become apparent by consideration of the detailed description and accompanying drawings.

DETAILED DESCRIPTION

Figure 2:
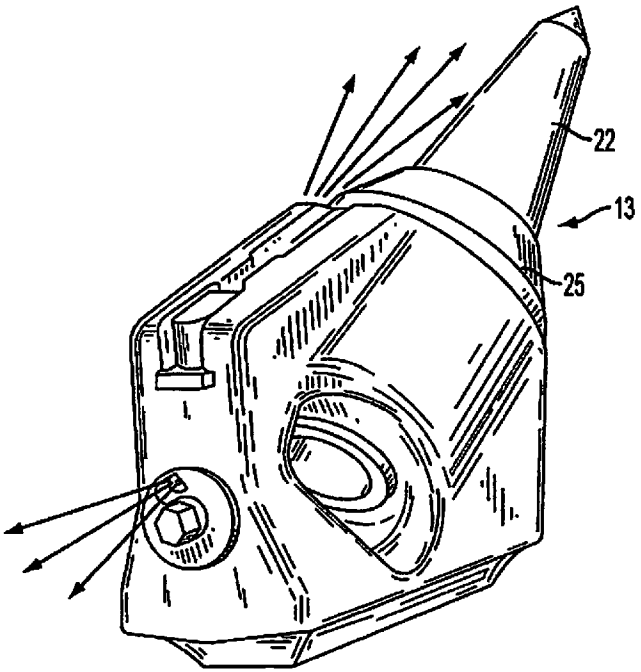
FIG. 2 PRIOR ART
FIG. 2 is a perspective view of the bit holder of FIG. 1.

Before one embodiment of the invention is explained in detail, it is to be understood that the invention is not limited in its application to the details of the construction and the arrangements of components set forth in the following description or illustrated in the drawings. The present invention is capable of other embodiments and of being practiced or being carried out in various ways. Also, it is to be understood that the phraseology and terminology used herein is for the purpose of description and should not be regarded as limiting. The use of "including," "comprising," or "having" and variations thereof as used herein is meant to encompass the items listed thereafter and equivalents thereof as well as additional items. The use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
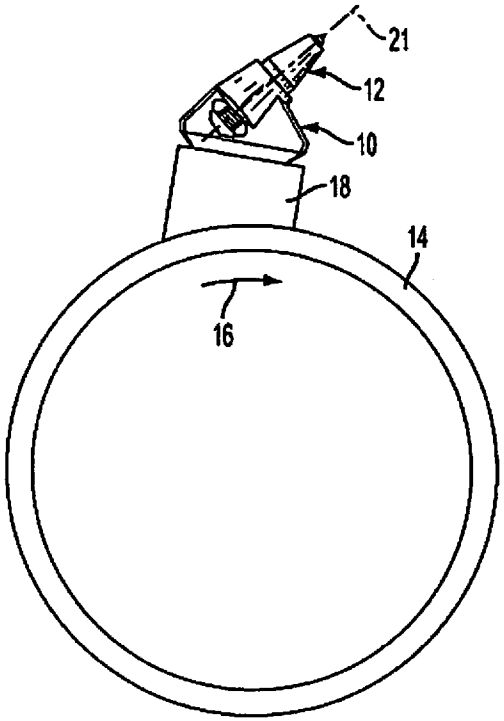
FIG. 1 PRIOR ART
FIG. 1 is a side elevation view of a conventional bit holder of the prior art attached to a cutting drum.
Figure 3:
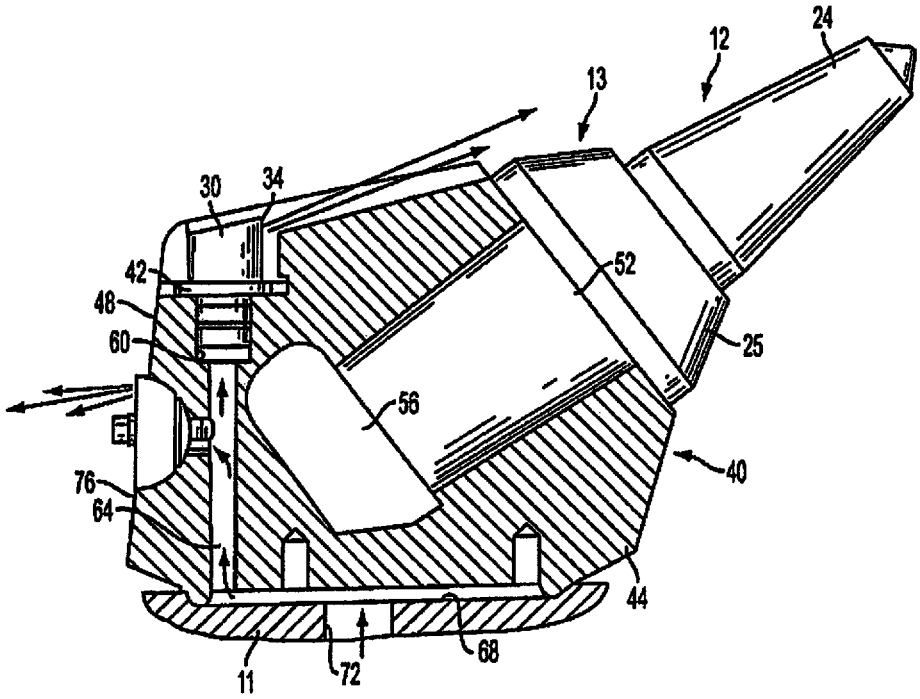
FIG. 3 PRIOR ART
FIG. 3 is a partial cut away view of the bit holder of FIG. 1

FIGS. 1-3 illustrate examples of conventional bit holding systems. These bit holding systems generally comprise a bit holder body, which is usually welded to a cutting drum, and a cutting bit retained in the bit holder body. In service, the cutting bits of these systems sometimes break off and the cylindrical shank portion of the cutting bit is left stuck in the bit holder or in a bit sleeve if one is used. The stuck and/or broken bit must be driven forward to be dislodged, but access to the rear portion of the bit is very limited due to the current structure of the bit holder body and the angle between an axis of the lower rear portion of the bit holder and the cutting bit (e.g., a 50° angle in existing bit holding systems).

Figure 4:
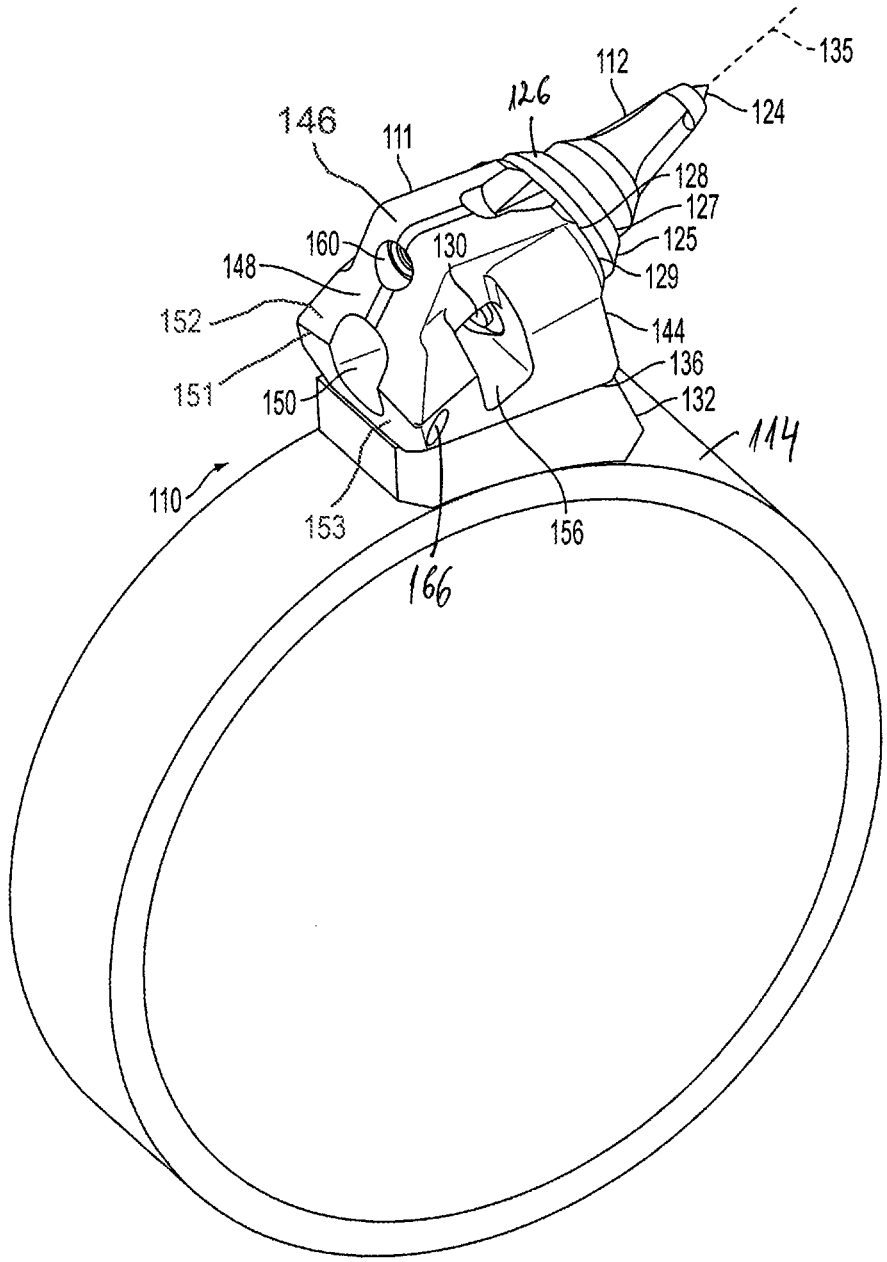
FIG. 4 is a perspective view of a bit holder according to an embodiment of the invention.

FIG. 4 illustrates a cutting tool assembly 110 according to an embodiment of the invention. The illustrated cutting tool assembly 110 is adapted for engagement with a rotating cutting drum 114, and is also automatically driven by the rotating drum 114. For the purposes of description, the forward end 144 of the cutting tool assembly 110 is considered the portion accepting a cutting 112 bit in FIG. 4, whereas the rearward end 148 of the cutting tool assembly 110 is opposite the forward end, and includes two openings (described in greater detail below). Thus, references herein to "forward direction" mean the cutting direction of the bit tip of the cutting bit 112.

Figure 5:
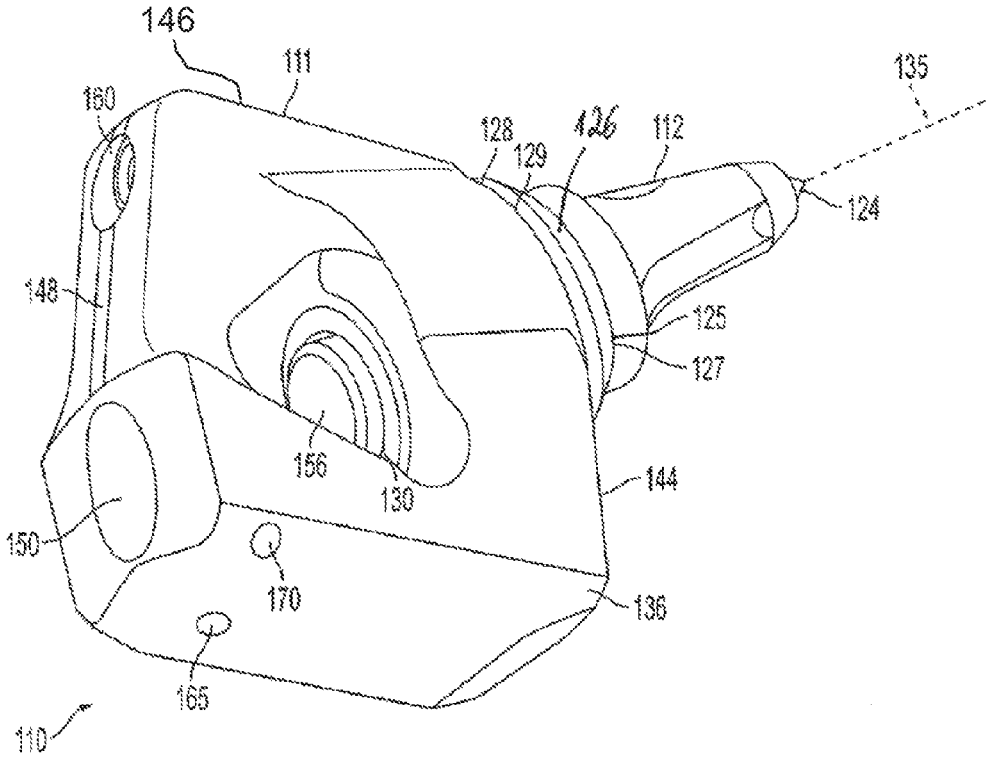
FIG. 5 is a perspective view of a bit holder according to another embodiment of the invention.

FIGS. 4 and 5 illustrate the general components of the cutting tool assembly 110. The assembly 110 comprises a bit holder body 111 including the forward portion 144, the rearward portion 148, an upper reinforcing portion 146 extending between the forward portion 144 and the rearward portion 148, and a generally planar mounting surface 136 between the forward and rearward portions. In the illustrated embodiment, the bit holder body 111 is connected with the rotating drum 114 (e.g., FIG. 4) via a mounting block or pedestal 132. Specifically, the bit holder 111 is mounted to the pedestal 132 by welding the mounting surface 136 of the bit holder to the pedestal. Further, the pedestal 132 is also mounted on the cutting drum 114 by welding. Other types of attachment of the bit holder 111 to the pedestal 132 and the rotating drum 114 are also possible. In other embodiments, the bit holder 111 attaches directly to the rotating drum 114.

The bit holder forward portion 144 defines an upwardly open front aperture 128 that includes a forward end 129 and a rearward end 130. In one embodiment, the cutting bit 112 is mounted in a bit sleeve 125 positioned in the front aperture 128. In alternative embodiments, the cutting bit 112 is mounted directly in the front aperture 128 of the bit holder body. The front aperture 128 has an axis that is inclined relative to the mounting surface. Further, the front aperture 128 is coaxial with the cutting bit 112. Thus, the front aperture 128 is adapted to receive the bit sleeve 125 so that the bit tip 124 extends in a forward direction. In some embodiments, the bit sleeve 125 is retained in the bit holder body 111 by a press fit. The press fit can be of a single diameter or of multiple diameters. In other embodiments, the bit sleeve 125 is retained in the bit holder body 111 by retaining rings, pins, or any other suitable mechanisms of attachment.

The cutting bit 112 of the assembly 110 includes a bit tip 124. In some embodiments, the assembly 110 further includes a bit sleeve member 125. The bit sleeve 125 includes an annular shoulder portion 126 adapted to receive the bit 112, and a bore or a bit aperture 127 (best shown in FIG. 7) extending through the bit sleeve 125. In other embodiments, sleeveless bit assemblies (not shown) can be used. For example, sleeveless bit assemblies are used where the cutting bit includes a shank with a larger diameter. In these embodiments, the cutting bit 111 is mounted directly in the front aperture 128 of the bit holder body. In other embodiments, cutting bits 112 with larger diameters can be also attached to a bit holder with a sleeve, where the bore 127 of the sleeve 125 is generally steeper in order to securely accept the bit 112. There are various systems and methods for attaching and supporting the cutting bit 112 to the sleeve 125 and to the bit holder body 111. Some of these methods and systems are described in U.S. Pat. No. 5,088,797, issued on Feb. 18, 1992 (which is incorporated herein by reference).

Figure 9:
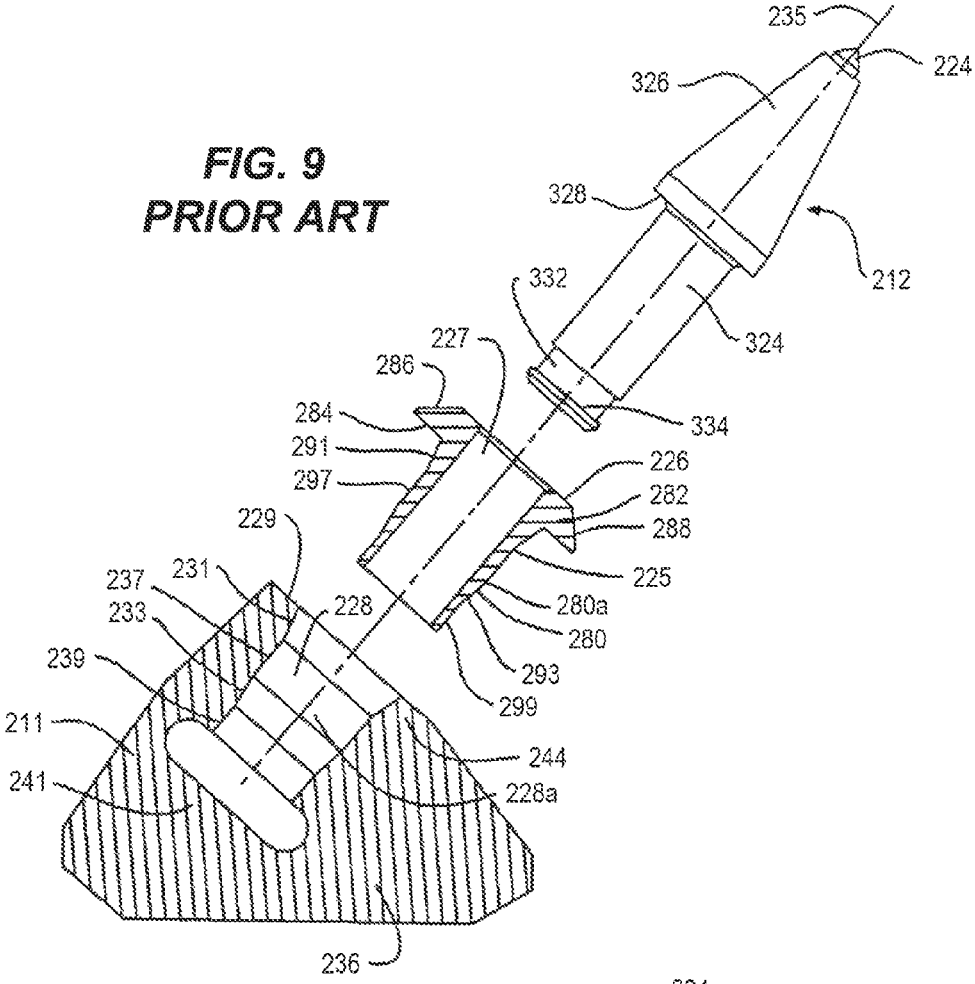
FIG. 9 PRIOR ART
FIG. 9 is an exploded cross-sectional view of a cutting tool assembly according to another embodiment.
Figure 10:
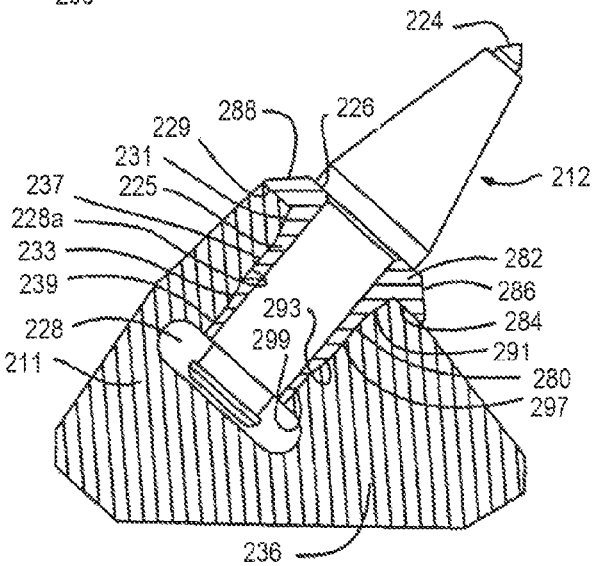
FIG. 10 PRIOR ART
FIG. 10 is a cross-sectional view of the cutting tool assembly of FIG. 9.

For example, as shown in FIGS. 9 and 10, the bit holder has a body portion 211 and a base portion 236. The base portion 236 attaches directly to the cutting drum 10 or indirectly by means of a mounting block (not shown). The body portion 211, which is integral to the base portion 236, includes an aperture 228 for receiving a coaxial sleeve 225. The aperture 228 defines an inner surface 228*a* and includes two conical sections 231 and 233 which are formed as sections of different cones. Disposed between the conical sections 231 and 233 is a first parallel section 237 of the aperture 228 which is parallel to the longitudinal axis 235 of the aperture 228. As such, the minimum diameter of section 231 is preferably equal to the maximum diameter of section 233. A second parallel section 239 of the aperture 228 is located adjacent to a trailing end 241 of the body portion 211 and is also parallel to a longitudinal axis 243 of the aperture 228. It will be understood by those skilled in the art that the parallel sections 237 and 239 need not be parallel to the longitudinal axis 243 but are preferred to be as such for manufacturing purposes. The body portion 211 also has a leading end 244 facing in the direction of rotation. The body portion 211 includes a contact face 229 which is shown as perpendicular to the longitudinal axis 243 which is the same as the central axis 235, of the aperture 228 but which may also be formed as a cone whose surface is at an angle with respect to the longitudinal axis 243 of the aperture 228.

The sleeve 225 has a body member 280 and a collar 282 with an inside surface 284 and an outside surface 286. The inside surface 284 of the collar 282 abuts the contact face 229. The outside surface 286 of the collar 282 has a beveled surface 288 and a flat surface 226. The body member 280 of the sleeve 225 defines an outer surface 280*a* which has a geometry which is complementary to the aperture 228. The sleeve 225 includes two conical sections 291 and 293, respectively, corresponding to the conical sections 231 and 233, respectively. As such, the conical sections 231 and 291, respectively, and the conical sections 233 and 293 are at an acute angle relative to the axis 235 of the bit 212. Disposed between the conical sections 291 and 293 is a first parallel section 297 which corresponds to the first parallel section 237 of the aperture 228. A second parallel section 299 corresponds to the first parallel section 239 of the aperture 228. The conical sections 231 and 291 are sized such that an interference fit of, for example, 0.002-0.005 inch, exists therebetween. Similarly, the conical sections 233 and 293 are sized such that an interference fit of, for example 0.002-0.005 inch, exists therebetween. Such areas of interference are referred to as bands of interference and are shorter than the length of the sleeve 225. The first parallel sections 237 and 297 are sized such that no interference exists therebetween. Similarly, the second parallel sections 239 and 299 are sized such that no interference exists therebetween.

The collar 282 is shown as having an inside surface 284 which is perpendicular to the longitudinal axis 243 of the aperture 228; however, the inside surface 284 can be conical having a conical surface at an angle with respect to the longitudinal axis 243 corresponding to the angle of the contact face 229.

The annular shoulder portion 126 of the sleeve 125 is adjusted to be attached to the top surface of the forward portion 144 such that bore 127 of the sleeve coaxially aligns with the front aperture 128 and a bit axis 135. The bore 127 releasably receives and engages at least a rotatable portion of the cutting bit 112 (e.g., a bit shank). The shank portion of the bit 112 is slightly smaller than the bore 127. The shank portion is inserted in the bore 127 and retained by a retaining ring or other suitable connections. The shank can rotate about the central axis 135 in order to avoid uneven wearing of the tip 124 of the cutting bit 112. In the embodiments where the cutting bit assembly does not include a sleeve, the front aperture 128 is coaxial with the cutting bit 112. Thus, in these embodiments, the front aperture 128 of the forward portion 144 is configured for attachment and directly accepts the cutting bit 112.

The bit holder body defines a central opening 156 between the front aperture 128 and a rear aperture 150 such that the rearward end of the cutting bit is exposed to the side of the bit holder. The sleeve 125 extends from the top surface of the forward portion 144 (i.e., the shoulder portion of the sleeve) to the rearward end 130 of the front aperture 128, and into the central opening 156. The central opening 156 assists in removal of the sleeve 125 and the cutting bit 112. More particularly, the bit holder body 111 comprises a one piece construction, with the central opening 156 being formed from side to side through the central portion of the bit holder 111, as shown in FIGS. 4 and 5. Thus, the central opening 156 forms a top bridge portion of the bit holder 111 that extends from the top of the rearward portion 148 to the top of the forward portion 144. In some embodiments, the rear portion of the bit 112 extends into the central opening 156. In other embodiments, the rear portion of the bit 112 does not extend into the central opening 156. In these embodiments, the rear portion of the bit 112 is retained in the bore 127 or the front aperture 128 by various retaining mechanisms.

The rearward portion 148 of the bit holder body 111 includes the rear aperture 150 that extends from the surface of the rearward portion 148 to the central opening 156. In one embodiment, the aperture 150 is open to the front aperture 128. Further, the rear aperture 150 has an axis coaxial with the axis of the front aperture. In addition, when the cutting tool assembly 110 includes a sleeve, the rear aperture 150 is aligned and is coaxial with the bore 127 of the sleeve. The rear aperture 150 can have different sizes and shapes. In one embodiment (FIG. 4), the rear aperture comprises of two "U" shaped halves positioned at an angle with respect to one another, the angle defined by the edge 151 in the rearward portion 148. The first "U" shaped half 152 is defined by the upper part of the rearward portion 148. The second "U" shaped half 153 is defined by the lower part of the rearward portion 148. Very often bit holders are positioned close to each other on the cutting drum 114 and, therefore, it is difficult to remove the broken bits. Thus, the proposed design of the rear aperture 150 increases the access and removal area of the bit holder and allows a broken cutting bit to be easily removed from the bit holder body.

The lower part of the rearward portion 148 is beveled and is adjacent to the mounting surface 136. In some embodiments, the rear aperture 150 extends into the bit holder from the beveled surface of the rearward portion. This design of the bit holder body 111 provides room for creating a rear aperture 150 that is larger than the shank portion of the cutting bit 112. In addition, it is advantageous that the rear aperture 150 is elongated in vertical direction. For example, in some embodiments, the rear aperture 150 can have a circular cross-section or an elliptical cross-section (FIG. 5). This would allow the bit 112 to be "rocked" upward or sideways to help remove the bit or clear obstructions, such as another bit holder body positioned behind. In alternative embodiments, the bit holder body is designed without the central opening 156. In these embodiments, the rear aperture 150 extends from the back surface of the rearward portion 148 to the bore 127 or the front aperture 128 of the forward portion 144.

In one embodiment, the rear aperture 150 has an inner dimension larger than the outer diameter of the shank portion of the cutting bit 112. That allows a broken bit 112 or a portion of the bit to be driven through the rear aperture 150 from the forward portion 144 of the bit holder body 111. Alternatively, the cutting bit 112 or a portion of the bit can be driven from the rearward portion 148 through the rear aperture 150 towards the openings in the forward portion 144. Thus, at least a portion of the cutting bit 112 can pass through the rear aperture 150 in any direction. In this aspect, the rear aperture 150 is configured to assist a user to remove a broken bit from the bit holder body 111. The broken bit is then replaced by mounting a new cutting bit 112 to the bit holder body 111.

As shown in FIGS. 4 and 5, the elongated lower part of the rearward portion 148 is beveled or angled downwardly and is coaxial with the front aperture 128 and the bit aperture 127. In the traditional bit holder assemblies (FIGS. 1-3), the lower part of the rearward portion 148 interfaces with the pedestal at a 50° angle relative to the cutting bit axis 135. These traditional designs of the rearward portion 148 prevented providing any type of opening in the rearward portion of the bit holder that is similar to the rear aperture 150. Such rear aperture 150 could not have been provided in the traditional bit holder assemblies because the rear aperture would intersect the weld joining the bit holder body and the pedestal and weaken it. In contrast, the lower part of the rearward portion 148 of the bit holder body 111 interfaces with the pedestal at a smaller angle relative to the bit axis 135 (e.g., 35° angle). This improved structure of the bit holder body 111 allows utilizing the rear aperture 150 in the manner described above.

In other embodiments, the rear aperture 150 has a smaller dimension that would not allow the cutting bit 112 to pass through the rear aperture 150. In these embodiments, a punching apparatus (e.g., a chisel) can be inserted and can pass thorough the rear aperture 150 to drive the cutting bit 112 in forward direction from behind. A punching apparatus can also be inserted through the rear aperture 150 and used to remove the bit 112 in the embodiments where the dimension of the rear aperture 150 is large enough to allow a broken bit 112 to be driven through it from the forward portion 144. In one embodiment, the rearward portion 148 or parts of the rearward portion are thickened to provide support and leverage when removing a broken bit.

Figure 7:
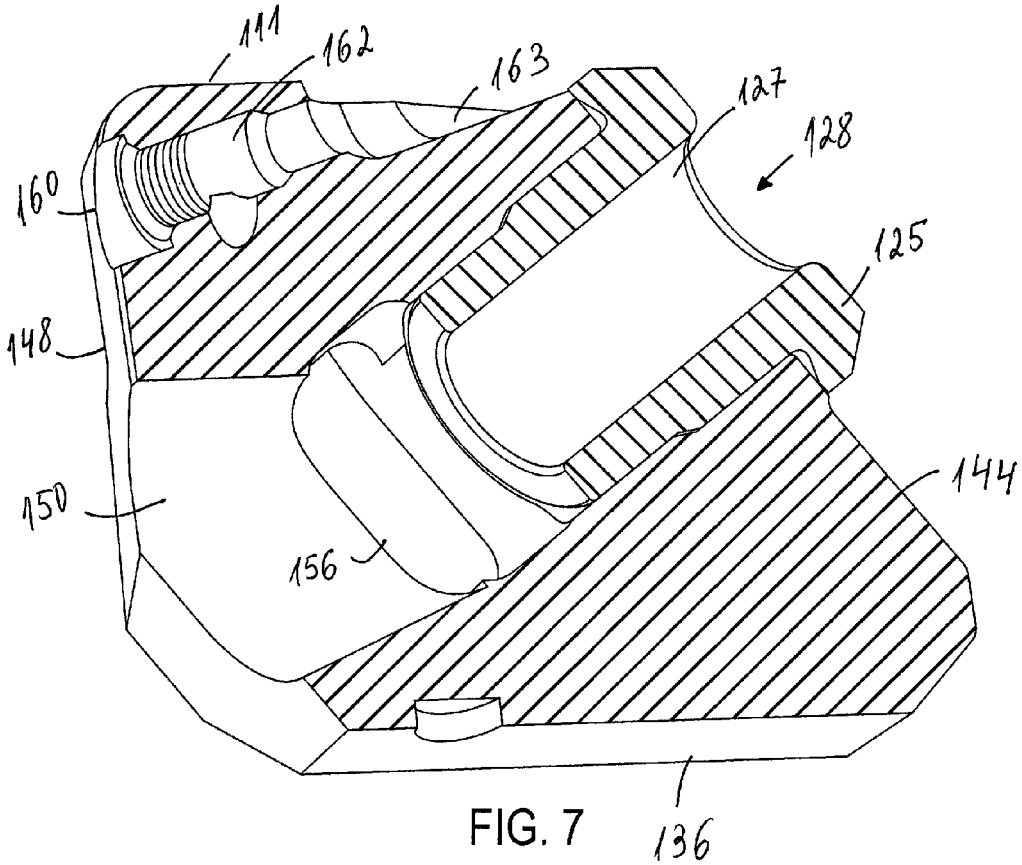
FIG. 7 is a cross-sectional view of the bit holder shown in FIG. 4.
Figure 8:
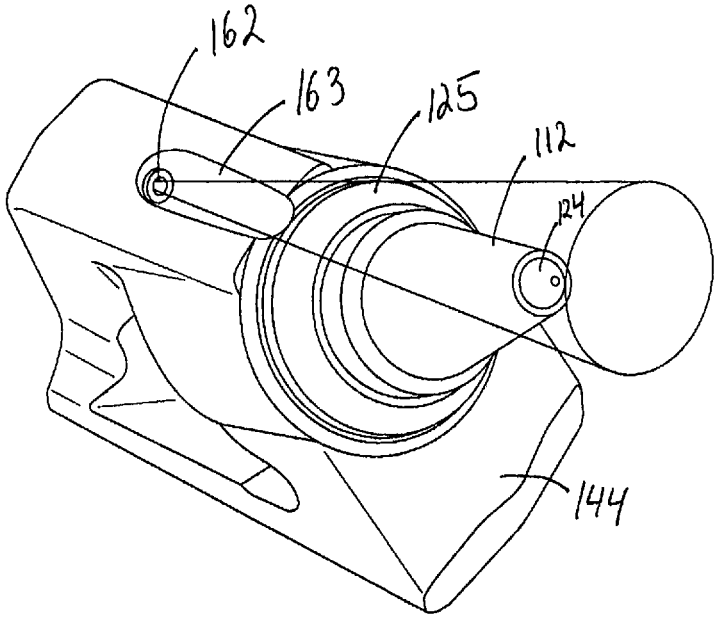
FIG. 8 is a top view of the bit holder shown in FIG. 4.

Bit holders often include a fluid (e.g., water) spray nozzle for dust and ignition control of the bit holder assembly during operation. As illustrated in FIGS. 4-7, the rearward portion 148 of the bit holder body 111 further includes a nozzle socket 160 for receiving a spray nozzle 162. Generally, the water spray nozzle 162 is fitted into the nozzle socket 160 and is supplied with water from fluid passageways in the bit holder body. As illustrated in FIGS. 7-8, the top portion of the bit holder includes a passage 163 connected with the spray nozzle 162 and consequently with the nozzle socket 160. The spray nozzle 162 sprays water in the direction of the bit tip 124 (FIG. 7). The nozzle socket 160 allows an easy access to the spray nozzle 162 and to the passage 163. In alternative embodiments, the spray nozzle 162 can spray water in different directions.

Figure 6:
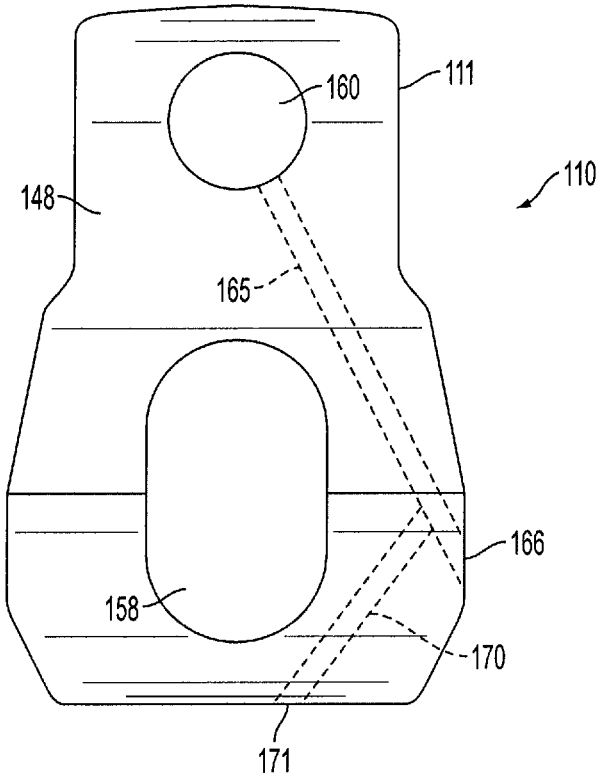
FIG. 6 is a rear view of the bit holder shown in FIG. 4.

As further shown in FIG. 6, the nozzle socket 160 is connected to fluid passageways that allow the incoming water to enter and/or exit the bit holder body 111. These passageways can be created during the molding of the bit holder body (e.g., by using an investment casting process) or can be drilled at a later time (e.g., when the bit holder body is created by forging). In one embodiment, the nozzle socket 160 is in communication with a first internal water passageway 165. The first internal water passageway 165 is drilled in slightly angled direction in relation to a vertical axis of the rearward portion 148, the water passageway 165 leaning inwardly and upwardly to intersect the nozzle socket 160. When the bit holder body 111 is attached to a mounting block 132, the bottom end or opening 166 of the first internal water passageway 165 is closed (e.g., welded) and can not pass water.

The bit holder body also includes a second internal water passageway 170. The second internal water passageway is drilled at an angle, starting at the bit holder's mounting surface 136 and angling outward. The second internal water passageway 170 intersects and communicates with the first internal water passageway 165. In some embodiments, the water supplied to the spray nozzle 162 enters the bit holder body through an opening 171 of the second water passageway 170. In these embodiments, the opening 171 is aligned with an opening in the mounting block 132 (not shown). Thus, when the bit holder body 111 is attached to the mounting block 132 or to a rotating cutting drum, the second internal water passageway 170 freely passes water to the water passageway 165.

In the embodiment illustrated in FIG. 6, the first internal water passageway 165 and the second internal water passageway 170 do not intersect with the rear aperture 150 or the central opening 156. In alternative embodiments, the cutting tool assembly can include internal water passageways that are positioned differently. For example, the cutting tool assembly can only include one passageway combining the second internal passageway 170 and the upper portion of the first internal water passageway 165 (i.e., eliminating the lower portion of the first internal water passageway 165). In other embodiments, the internal water passageways can intersect and communicate with the rear aperture 150. It is also possible that the cutting tool assembly 110 does not include any internal water passageways.

Various features and advantages of the invention are set forth in the following claims.

What is claimed is:

1. A cutting tool assembly comprising:

a bit holder comprising a forward portion, a rearward portion, and a central opening positioned between the forward portion and the rearward portion, an upper reinforcing portion extending between the forward portion and the rearward portion, and a generally planar mounting surface between the forward and rearward portions positioned on an opposite side of the central opening from the upper reinforcing portion, the forward portion defining a front end and a front aperture having an axis inclined relative to the mounting surface, and the rearward portion defining a rear aperture open to the front aperture; and a cutting bit mounted in the front aperture and including a rearward end accessible through the rear aperture of the bit holder rearward portion and accessible through the central opening, the cutting bit extending beyond the front end.

2. The cutting tool assembly of claim 1, wherein the cutting tool assembly comprises a bit sleeve mounted in the front aperture of the bit holder, the bit sleeve defining a bit aperture accepting the cutting bit.

3. The cutting tool assembly of claim 2, wherein the bit aperture has an axis coaxial with the axis of the front aperture.

4. The cutting tool assembly of claim 1, wherein the cutting bit comprises a shank portion having an outer diameter, and wherein the rear aperture has an inner dimension larger than the outer diameter, to allow the shank portion of a broken cutting bit to pass through the rear aperture.

5. The cutting tool assembly of claim 1, wherein the rear aperture has a circular cross-section.

6. The cutting tool assembly of claim 1, wherein the rear aperture has an elliptical cross-section.

7. The cutting tool assembly of claim 1, wherein the rear aperture has an axis coaxial with the axis of the front aperture.

8. The cutting tool assembly of claim 1, wherein the rearward portion further comprises a beveled surface adjacent the mounting surface, and wherein the rear aperture extends into the bit holder from the beveled surface.

9. The cutting tool assembly of claim 1, further comprising a cutting drum, a mounting block on the cutting drum, and wherein the bit holder is connected to the mounting block.

10. The cutting tool assembly of claim 1, wherein the bit holder includes a fluid passageway and a nozzle socket in the rearward portion for receiving a fluid spray nozzle, the nozzle socket communicating with the fluid passageway.

11. The cutting tool assembly of claim 10, wherein the fluid passageway does not communicate with the rear aperture.

12. The cutting tool assembly of claim 1, wherein the rearward end of the cutting bit is exposed to the side of the bit holder.

13. The cutting tool assembly of claim 1, wherein the upper reinforcing member includes an upper surface that is coextensive with an upper surface of the forward portion and the rearward portion.

14. The cutting tool assembly of claim 1, wherein the rearward portion includes an upper surface and lover surface that are joined along an edge, wherein the rear aperture extends through a portion of the edge.

15. A cutting tool assembly comprising:

a bit holder comprising a forward portion, a rearward portion, a central opening positioned between the forward portion and the rearward portion, an upper reinforcing portion extending between the forward portion and the rearward portion, and a generally planar mounting surface between the forward and rearward portions positioned on an opposite side of the central opening from the upper reinforcing portion and configured to be coupled to a cutting drum, the forward portion defining a front end and a front aperture having an axis inclined relative to the mounting surface, and the rearward portion having a beveled surface, adjacent the mounting portion and defining a rear aperture extending from the beveled surface, the rear aperture having an inner dimension and being open to the front aperture; and a cutting bit mounted in the front aperture and including a shank portion having an outer diameter and a rearward end accessible through the rear aperture of the bit holder rearward portion, accessible through the central opening, the cutting bit extending beyond the front end, and wherein the inner dimension of the rear aperture is larger that the outer diameter of the cutting bit to allow the shank portion of a broken cutting bit to pass through the rear aperture for removal.

16. The cutting tool assembly of claim 15, wherein the cutting bit comprises a bit sleeve mounted in the front aperture of the bit holder, the bit sleeve defining a bit aperture accepting the cutting bit.

17. The cutting tool assembly of claim 16, wherein the bit aperture has an axis coaxial with the axis of the front aperture.

18. The cutting tool assembly of claim 15, wherein the rear aperture has a circular cross-section.

19. The cutting tool assembly of claim 15, wherein the rear aperture has an elliptical cross-section.

20. The cutting tool assembly of claim 15, wherein the rear aperture has an axis coaxial with the axis of the front aperture.

21. The cutting tool assembly of claim 15, wherein the bit holder further comprises a top portion including a passage connected with a spray nozzle and a nozzle socket.

22. A cutting tool assembly comprising:

a bit holder comprising a forward portion, a rearward portion, a central opening positioned between the forward portion and the rearward portion, an upper reinforcing portion extending between the forward portion and the rearward portion, and a generally planar mounting surface between the forward and rearward portions positioned on an opposite side of the central opening from the upper reinforcing portion, the forward portion defining a front end and a front aperture having an axis inclined relative to the mounting surface, and the rearward portion having a beveled surface adjacent the mounting surface and defining a rear aperture extending from the beveled surface, the rear aperture having an inner dimension and being open to the front aperture;

a cutting bit mounted in the front aperture and including a shank portion having an outer diameter and rearward end accessible through the rear aperture of the bit holder rearward portion and accessible through the central opening, the cutting bit extending beyond the front end, and wherein the inner dimension of the rear aperture is larger than the outer diameter of the cutting bit to allow the shank portion of a broken cutting bit to pass through the rear aperture for removal;

a sleeve member having a body member constructed to be received in the front aperture through a forward end of the front aperture, the body member defining an outer surface, the sleeve member having an abutment surface adapted for engagement with a contact face of the forward portion to prevent axial movement of the sleeve member in a direction toward the rearward portion, the sleeve member further having a bore therein for coaxially rotatably receiving the shank portion of the cutting bit and an engagement surface adapted to be engaged by a shoulder on the bit; and means for retaining the sleeve member relative to the forward portion comprising an area of interference fit between an inner surface of the front aperture and the outer surface adapted to prevent rotation and axial movement of the sleeve member while in use without the application of independent means for urging the sleeve member toward the rearward portion of bit holder and to allow the removal of the sleeve member from the front aperture of the front portion by the manual application of force to the sleeve member.

23. The apparatus of claim 22, wherein the means for retaining the sleeve member include one or more bands of interference fit between the inner surface and the outer surface, where the one or more bands of interference fit are shorter than the outer surface.

24. The apparatus of claim 22, wherein the means for retaining said sleeve member includes one or more bands of interference fit between the inner surface and the outer surface, and wherein the sleeve is cylindrical.

25. The apparatus of claim 22, wherein the sleeve includes an area of increased diameter along the outer surface adjacent the forward end of the front aperture and the front aperture includes an area of reduced diameter adjacent the rearward portion such that two bands of interference fit exist between the outer surface and the inner surface, one at the area of increased diameter of the outer surface and the other at the area of reduced diameter of said inner surface.

26. A cutting tool assembly comprising:

a bit holder comprising a forward portion, a rearward portion, a central opening positioned between the forward position and the rearward portion, an upper reinforcing portion extending between the forward portion and the rearward portion, and a generally planar mounting between the forward and rearward portions positioned on an opposite side of the central opening from the upper reinforcing portion, the forward portion defining a front end and a front aperture having an axis inclined relative to the mounting surface, and the rearward portion having a beveled surface adjacent the mounting surface and defining a rear aperture extending from the beveled surface, the rear aperture having an inner dimension and being open to the front aperture;

a cutting bit mounted in the front aperture and including a shank portion having an outer diameter and a rearward end accessible through the rear aperture of the bit holder rearward portion and accessible through the central opening, the cutting bit extending beyond the front end, and wherein the inner dimension of the rear aperture is larger than the outer diameter of the cutting bit to allow the shank portion of a broken cutting bit to pass through the rear aperture for removal;

a sleeve member having a body member and a collar located a tone end of the sleeve member, the body member positioned in the front aperture through a forward end of the front aperture, the body member defining a outer surface, the collar having an inside surface and an outside surface, the inside surface engaged with a contact face of the forward portion to prevent axial movement of the sleeve member in direction toward the rearward portion, the sleeve member further having a bore that receives the shank portion of the cutting bit such that a shoulder on the bit engages the outer surface of the collar; and an area of interference fit between an inner surface of the front aperture and the outer surface, wherein the sleeve member is retained relative to the forward portion by the area of interference fit, wherein the area of interference fit prevents rotation and axial movement of the sleeve member while in use without urging the sleeve member toward the rearward portion of the bit holder, and wherein the area of interference fit is adapted to allow the axial removal of the sleeve member from the front aperture of the front portion by the manual application of force to the sleeve member.

27. A cutting tool assembly comprising:

a bit holder comprising a forward portion, rearward portion, a central opening positioned between the forward portion and the rearward portion, an upper reinforcing portion extending between the forward portion and the rearward portion, and a generally planar mounting surface between the forward and rearward portions positioned on an opposite side of the central opening from the upper reinforcing portion, the forward portion defining a front end and a front aperture having an axis inclined relative to the mounting surface, and the rearward portion having a beveled surface adjacent the mounting surface and defining a rear aperture extending from the beveled surface, the rear aperture having an inner dimension and being open to the front aperture;

a cutting bit mounted in the front aperture and including a shank portion having an outer diameter and a rearward end accessible through the rear aperture of the bit holder rearward portion and accessible through the central opening, the cutting bit extending beyond the front end, and wherein the inner dimension of the rear aperture is larger than the outer diameter of the cutting bit to allow the shank portion of a broken cutting bit to pass through the rear aperture for removal;

a cylindrical sleeve member having a body member and a collar located at one end of the sleeve member, the body member positioned in the front aperture through a forward end of the front aperture, the body member defining an outer surface, the collar having an inside surface and an outside surface, the inside surface engaged with a contact face of the forward portion to prevent axial movement of the sleeve member in a direction toward the rearward portion, the sleeve member further having a bore that receives the shank portion of the cutting bit such that a shoulder on the bit engages the outer surface of the collar, the sleeve member including at least two sections forming portions of a cone which are not part of the same cone; and an area of interference fit between an inner surface of the front aperture and the outer surface, wherein the sleeve member is retained relative to the forward portion by the area of interference fit, wherein the area of interference fit prevents rotation and axial movement of the sleeve member while in use without urging the sleeve member toward the rearward portion of the bit holder, and wherein the area of interference fit is adapted to allow the axial removal of the sleeve member from the front aperture of the front portion by the manual application of force to the sleeve member.

* * * * *